United States Patent [19]

Hooper

[11] 4,068,629

[45] Jan. 17, 1978

[54] STEPPED PISTON TWO STROKE ENGINES

[76] Inventor: Bernard Hooper, Maybank House, Hope Street, Wordsley, Stourbridge, West Midlands, England

[21] Appl. No.: 678,935

[22] Filed: Apr. 21, 1976

[30] Foreign Application Priority Data

Apr. 25, 1975 United Kingdom ..... 17170/75
Dec. 31, 1975 United Kingdom ..... 53386/75

[51] Int. Cl.[2] ..... F02B 75/02

[52] U.S. Cl. ..... 123/65 S; 123/66; 123/73 B; 123/73 C; 123/73 F; 123/139 AW

[58] Field of Search ..... 123/59 BS, 65 S, 66, 123/73 A, 73 B, 73 C, 73 CC, 73 F, 74 A, 139 AW

[56] References Cited

U.S. PATENT DOCUMENTS

| | | | |
|---|---|---|---|
| 1,164,454 | 12/1915 | Bihan | 123/59 BS |
| 1,632,988 | 6/1927 | Adams | 123/73 C |
| 2,213,683 | 9/1940 | Banning | 123/139 AW |
| 3,687,118 | 8/1972 | Nomura | 123/73 CC |
| 3,826,233 | 7/1974 | Mennesson | 123/139 AW |

FOREIGN PATENT DOCUMENTS

| | | | |
|---|---|---|---|
| 759,044 | 1/1934 | France | 123/73 A |
| 209,012 | 4/1908 | Germany | 123/59 BS |

*Primary Examiner*—Charles J. Myhre
*Assistant Examiner*—Craig R. Feinberg
*Attorney, Agent, or Firm*—Merriam, Marshall & Bicknell

[57] ABSTRACT

A stepped piston two cycle engine, of the type including at least one set of two cylinders each such cylinder having a working part of smaller diameter and a pumping part of larger diameter, at least the air for each charge required by the working part of each cylinder of the set being pumped along transfer passage means from the pumping part of the other cylinder of the set, has the working part of each cylinder provided with exhaust port means, main inlet ports, and auxiliary inlet port means. The main inlet ports are arranged symetrically about and spaced from a plane which contains a longitudinal axis of the cylinder and which passes through the center of the exhaust port means, and the auxiliary inlet port means is provided in the cylinder wall opposite to the exhaust port means. Main and auxiliary transfer passages are provided for the main and auxiliary inlet ports, the auxiliary inlet ports and auxiliary transfer passages lying wholly on one side of an axial plane which contains the axes of the two cylinders of the set, while the exhaust ports of both cylinders lie on the other side of this plane.

Air only may be supplied to the working part of each cylinder through the main inlet ports, while fuel is injected into the air passing through the auxiliary transfer passages so that a mixture of fuel and air enters the working parts of the cylinders through the auxiliary inlet ports. By this means charge stratification in the working parts of the cylinders can be achieved.

6 Claims, 4 Drawing Figures

STEPPED PISTON TWO STROKE ENGINES

BACKGROUND OF THE INVENTION

FIELD OF THE INVENTION

This invention relates to multi-cylinder, two-stroke engines of the type comprising at least one set of two cylinders, each such cylinder having a working part of the smaller diameter and a pumping part of larger diameter; a piston slidably reciprocable in each cylinder and having a working part which slides in the working part of the cylinder and a pumping part which slides in the pumping part of the cylinder; and transfer passage means between the pumping part of each cylinder of the or each set and the working part of the other cylinder of the set so that, in the or each set, at least the air for each charge required by the working part of each cylinder of the set is pumped, during operation of the engine to such working part along transfer passage means from the pumping part of the other cylinder of the set, the piston motion within the cylinders of each set being such that the pistons are 180° out of phase, i.e., each piston of the set is at outer dead-centre when the other piston of the set is at inner dead-centre.

Hereinafter, engines of the above type are referred to as being "of the type specified".

SUMMARY OF THE INVENTION

It is an object of the present invention to provide an improved engine of the type specified.

According to the invention, I provide an engine of the type specified wherein the working part of each cylinder is provided with exhaust port means, main inlet ports and auxiliary inlet port means, the main inlet ports being arranged symmetrically about, and spaced from, a plane which contains the longitudinal axis of the cylinder and which passes through the center of the exhaust port means, the auxiliary inlet port means comprising a port or ports in the cylinder wall opposite to the exhaust port means, the transfer passage means comprising main transfer passage means connected to the main inlet port means and auxiliary transfer passage means connected to the auxiliary inlet port means, the exhaust port means of both cylinders of the or each set lying to one side of an axial plane containing the axes of the two cylinders of the set and the auxiliary inlet port means of both cylinders of the or each set, and the auxiliary transfer passage means of the or each set lying wholly on the other side of said axial plane.

Preferably, each main transfer passage means comprises a first portion extending from the pumping part of one of the cylinders generally parallel to said axial plane and a second U-shaped portion leading to the main inlet ports of the working part of the other cylinder, at least said first portions lying on the same side of the axial plane as the exhaust port means.

By this arrangement, particularly advantageous flowpaths of gas within the working parts of the cylinders can be achieved, as will hereafter be more fully described. Further, the mechanical lay-out of the engine with this arrangement of main and auxiliary inlet port means and main and auxiliary transfer passage means is relatively simplified.

Preferably the limbs of the generally U-shaped portion of each main transfer passage means are of substantially equal lengths, so that the amounts of gas passing through the limbs are substantially equal to give rise to symmetrical gas flows within the working parts of the cylinders.

The engine may be provided with means to supply fuel to air which, when the engine is in use, passes through the auxiliary transfer passage means and the auxiliary inlet port means. This may be achieved by arranging for a low pressure fuel injector to spray fuel into each auxiliary transfer passage means. An intermittent timed flow type of injector operated in timed relation with the engine or a continuous flow injector may be utilised for this purose, the quantity of fuel discharged being variable.

Each auxiliary transfer passage means may be provided with a well formation arranged to retain any liquid fuel deposited in such passage until such fuel is displaced from the well by air passing through the passage.

By this means the charge of fuel and air which is compressed in the working part of each cylinder can be arranged to be stratified, in that one zone of the working part of the cylinder contains a mixture of fuel and air while another zone contains substantially air alone.

Preferably the auxiliary inlet port means has a cross-sectional area less than half of that of the main inlet port means. The auxiliary inlet port means is also preferably arranged to open after the main inlet port means in order to ensure that the main inlet air stream is established before the fuel and air mixture is admitted through the auxiliary inlet port means.

The engine may further include means for sensing variations in the mass flow of air into the pumping parts of the cylinders of the or each set, and means for metering of fuel supply in dependence on variations in said mass flow of air.

The means for sensing variations in the mass flow of air may be a piston movable in response to pressure variation in an inlet manifold or the like through which the air flows into the engine.

BRIEF DESCRIPTION OF DRAWINGS

The invention will now be described by way of example with reference to the accompanying drawings, of which.

DESCRIPTION OF PREFERRED EMBODIMENTS

Figure 1:
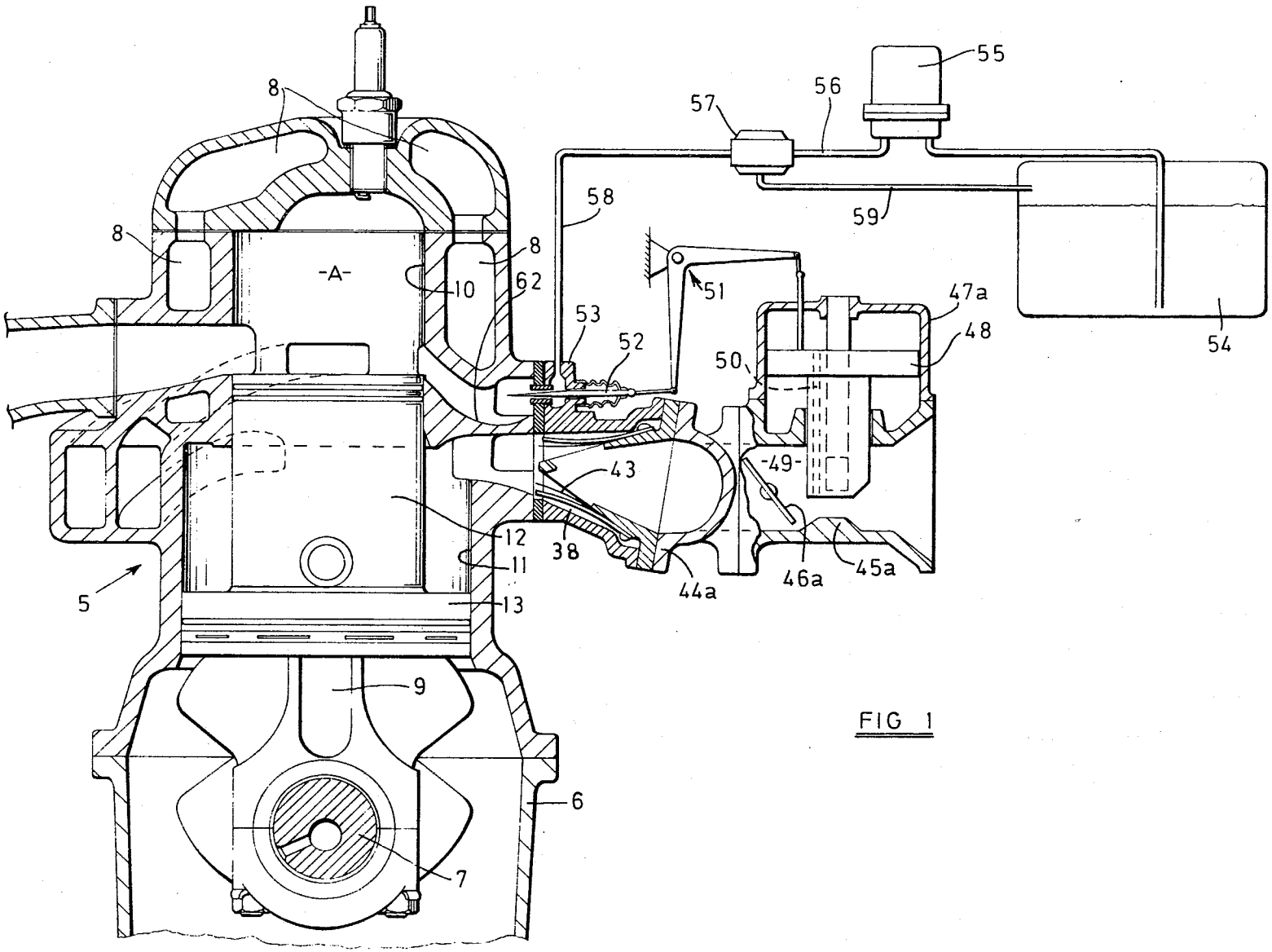
FIG. 1 is a section through one cylinder of a set of cylinders of an engine of the type specified.

Referring firstly to FIG. 1, the set of cylinders there shown forms part of an engine including a cylinder block 5, and a crank case 6 in which is rotationally mounted a crankshaft 7. The engine is intended to be liquid cooled, and the cylinder block 5 is accordingly provided with liquid passages 8.

The cylinder shown in FIG. 1 has a working part 10 and a pumping part 11, and slidable in the cylinder is a piston having a working part 12 and a pumping part 13, the piston being connected to one throw of the crank shaft by a connecting rod 9. The cylinder shown in FIG. 1 will be designated A and is shown in FIG. 2, and the other cylinder of the set is indicated at B in FIG. 2.

Cylinder B has a working part 14 and a pumping part 15.

Figure 2:
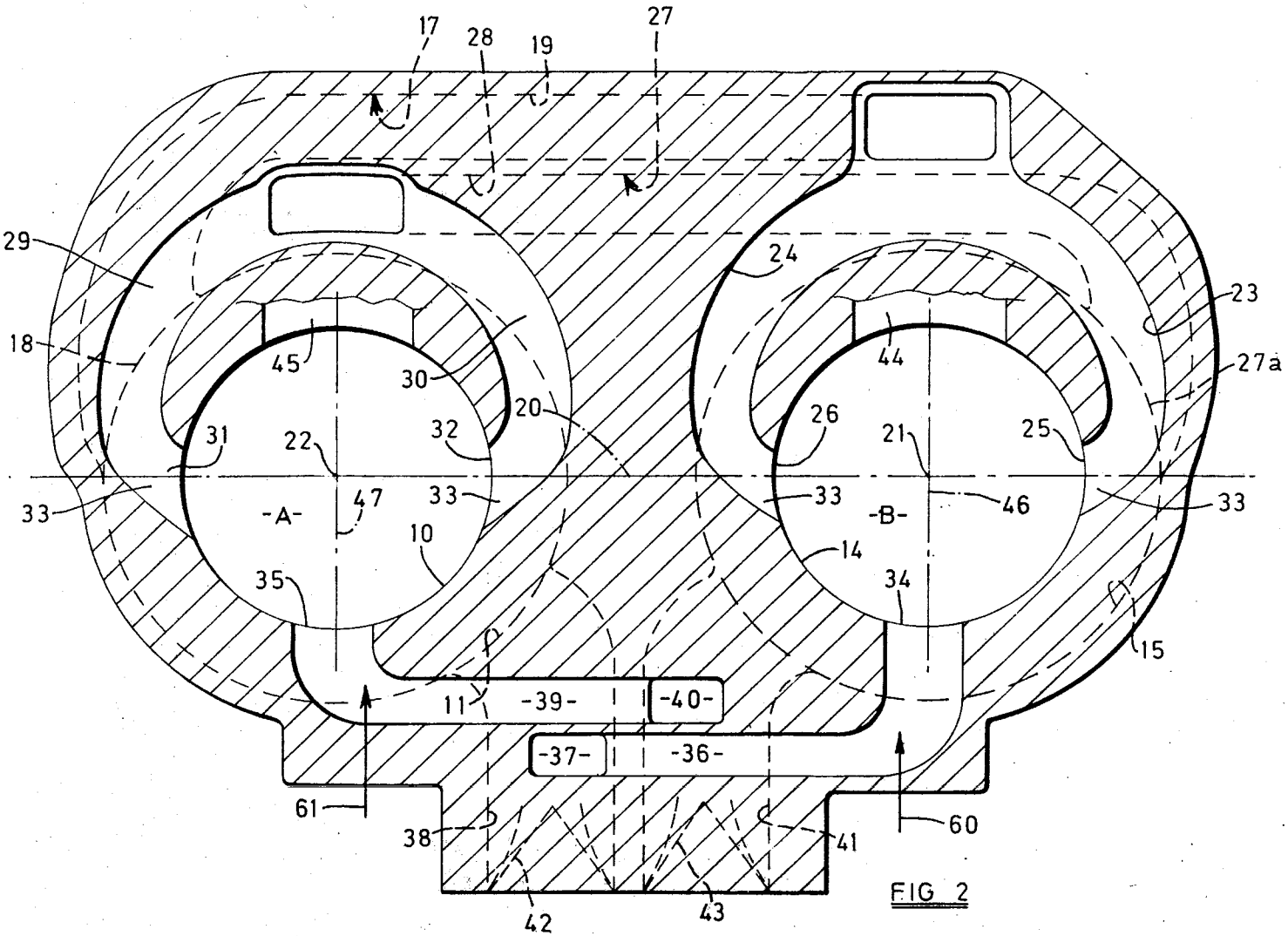
FIG. 2 is a horizontal section through the two cylinders of the set.

Referring now to FIG. 2, cylinders A and B each have associated therewith main transfer passage means which extend between the pumping part of one cylinder of the set and the working part of the other cylinder, respectively. The main transfer passage means includes a transfer passage 17 extending from a port 18 in the pumping part 11 of cylinder A, this transfer passage having a portion 19 which is generally parallel to an axial plane 20 which passes through the longitudinal axes 21 and 22 of the cylinders A and B. At its right-hand end, the transfer passage 17 forms into two branches 23 and 24 which lead respectively to main inlet ports 25 and 26 in the working part 14 of cylinder B. In a similar manner, there is a main transfer passage 27 leading from a port 27*a* in the pumping part 15 of cylinder B and having a portion 28 which is parallel to the axial plane 20. At its left-hand end, the transfer passage 27 branches into parts 29 and 30 which feed main inlet ports 31 and 32 in the working part 10 of cylinder A.

It will be seen that substantially the whole of the transfer passages 17 and 27 lie to one side of the axial plane 20. There are however small portions of the transfer passage means which are indicated at 33 and which lie to the other side of the plane 20, these portions 33 being immediately adjacent to the main inlet ports 25, 26, 31 and 32.

Each cylinder is also provided with auxiliary inlet ports, the auxiliary inlet port for cylinder B being indicated at 34 and the auxiliary inlet port for cylinder A being indicated at 35. The auxiliary inlet port 34 is fed by an auxiliary transfer passage 36 which extends from a port 37 in a passage 38 leading to the pumping part 11 of the cylinder A. In a similar manner, the auxiliary inlet port 35 is supplied via an auxiliary transfer passage 39 fed from a port 40 in a passage 41 leading to the pumping part 15 of cylinder B. The passages 38 and 41 are provided with reed valves 42 and 43 respectively. It will be seen that the auxiliary transfer passages 36 and 39 lie wholly to the side of the axial plane 20 remote from that on which substantially the whole of the transfer passages 17 and 27 lie.

The auxiliary inlet port of each cylinder has an area less than half that of the main inlet ports of the cylinder.

The working parts of the cylinders A and B are provided with exhaust ports 45 and 44 respectively. The exhaust ports 44 and 45 are disposed diametrically opposite (as viewed in plan) the auxiliary inlet ports 34, 35, respectively and are intersected by transverse planes 46 and 47 which pass through the axes 21 and 22 of the cylinders and also intersect, substantially centrally, the auxiliary inlet ports 34 and 35. It will be seen that the transverse planes 46 and 47 are substantially perpendicular to the axial plane 20 in the particular embodiment of engine shown in FIG. 2.

Turning now to FIG. 1, the passages 38 and 41 containing the reed valves 42 and 43 are fed by an inlet manifold 44*a* to which is connected a throttle housing 45*a* containing a throttle 46*a*. A chamber 47*a* is carried by the housing 45*a* and has slidable therein a piston 48. The depression in the air inlet passage 49 is communicated to the chamber 47*a* above the piston 48 through a passage 50 in the piston. The piston is connected by linkage, indicated diagrammatically at 51, with a metering needle 52 in a fuel metering device 53. The device 53 is supplied with fuel in a manner which will now be described.

A fuel tank is indicated at 54 and fuel is extracted from the tank by means of a fuel pump 55; the fuel under pressure is passed along a line 56 to a fuel pressure regulating valve 57 which controls the pressure in the fuel feed line 58 and returns excess fuel to the tank along the line 59. Fuel is thus supplied at a constant pressure along the fuel feed line 58 to the fuel metering device 53. The amount of fuel which is delivered by the fuel metering device depends on the setting of the needle 52 which in turn depends on the position of the piston 48. Fuel metering devices such as 53 are provided at the points 60 and 61 in the auxiliary transfer passages 36 and 39.

The fuel metering devices 53 will deliver fuel continuously to the auxiliary transfer passages, but the amount of such fuel delivered will depend on the mass flow of the air into the pumping parts of the cylinders through the air inlet passage 49. Thus, the fuel supply will be adjusted to the air flow thus allowing control of the combustion conditions in the cyliners, and assisting control of exhaust emissions.

Beneath the points 60 and 61 in the auxiliary transfer passages 36 and 39, these passages are formed with wells of which the one in passage 39 is designated 62 in FIG. 1. These wells are arranged to retain any liquid fuel deposited in the auxiliary transfer passages, and prevent such fuel running down into the pumping parts of the cylinders.

In operation of the engine, air from the pumping part of one cylinder of the set passes through the main and auxiliary transfer passages into the working part of the other cylinder of the set by way of the main and auxiliary transfer ports in that cylinder. Air alone enters the working part through the main transfer ports, but the air entering through the auxiliary transfer port has fuel fed into it by the fuel metering devices such as 53.

Figure 3:
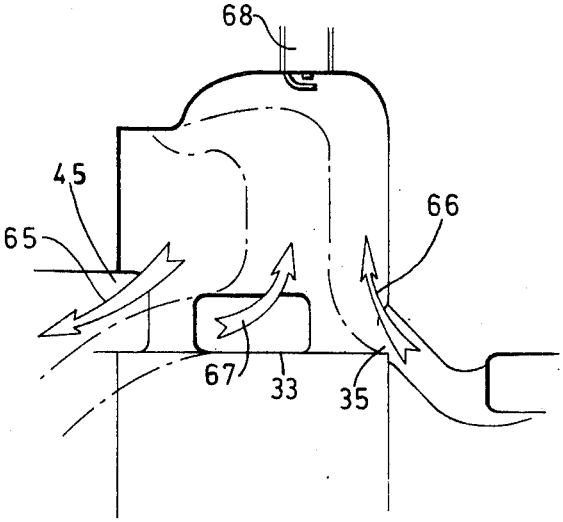
FIG. 3 is a section through the working part of the one cylinder showing gas flow paths therein.

The flows of gas which occur in the working part of the cylinder at this stage of the operating cycle of the engine are most clearly seen with reference to FIG. 3 of the drawings, which shows a section through cylinder A of the set. The main inlet ports 31 and 32 of cylindr A enter the cylinder substantially perpendicular to its axis, but are arranged to direct the flow of air towards the part of the cylinder adjacent to the auxiliary inlet port 35. The auxiliary inlet port 35 enters the cylinder at an angle of, for example, about 45° to the cylinder wall, to direct its flow of fuel and air upwardly towards a point on the cylinder head located on the transverse plane 46. When the working part of the piston has moved down a sufficient distance that all the ports in the cylinder wall are uncovered, residual gases from the previous combustion process are expelled from the cylinder in the direction of arrow 65 through exhaust port 45. The mixture of fuel and air enters the cylinder through auxiliary inlet port 35 in the direction of arrow 66, and two streams of air enter the cylinder in the direction of arrow 67 via the main inlet ports. The result of this is that the region of the cylinder occupied by the spark plug contains a mixture of fuel and air, while the remainder of the cylinder is filled mainly with air alone. It will be course be appreciated that the regions occupied by the fuel-air mixture and by air alone do not have precise boundaries since a degree of mixing inevitably occurs.

The auxiliary inlet port of the cylinder is preferably arranged to open after the main inlet ports, so that air flow through the latter is established before the flow of air and fuel through the auxiliary port commences.

By this means a combustible mixture is established in the region of the cylinder in which ignition occurs. However, the cylinder as a whole can be made to contain an excess of air over that normally required for combustion (but which would lead to the establishment of a fuel-air mixture too weak for satisfactory ignition if the fuel were evenly distributed throughout the cylinder). Such operation is desirable in certain cases in meeting emission control requirements.

Figure 4:
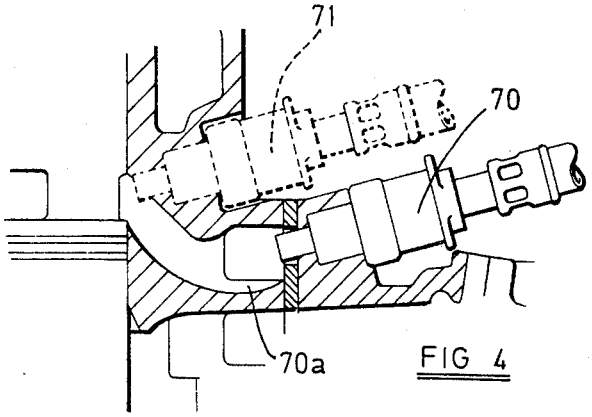
FIG. 4 is a section through part of a modified form of the engine of FIG. 1.

FIG. 4 shows two further alternative arrangements by which fuel may be introduced into the auxiliary transfer passages. A low pressure injector can be mounted as at 70 to inject fuel in a generally downwardly direction into the well 70*a* in the auxiliary transfer passage. Alternatively, an injector mounted as at 71 can be fitted, the injector in this case spraying fuel through the auxiliary inlet port directly into the working part of the cylinder and being inclined at an angle of at least 30° to the direction of discharge of the auxiliary inlet port means.

When the injector is positioned as the injector 70, a low pressure fuel injector of intermittent timed flow type or of continuous flow type can be utilised, but when the injector is positioned as at 71 the injection system is preferably of intermittent timed flow type arranged to spray fuel only during the period when air is passing through the auxiliary transfer passage into the working part of the cylinder.

Further modifications may be incorporated in the described fuel supply system for the engine. For example, in place of the pressure regulating valve 57 a float chamber arrangement or weir device may be utilised to ensure a constant pressure head of fuel supplied to the metering device 53. The signal derived from the air flow sensor and applied to the metering device 53 could be augmented by signals obtained from sensors responsive to parameters such as exhaust gas temperature, oxygen content of exhaust gasses, etc. to provide a feed back system compensating for variations in atmospheric temperature, fuel temperature, and other factors which could upset the supply of a correct ratio of air to fuel to the engine. It will also be appreciated that mass flow sensors other than a piston cylinder device could be utilised, for example a diaphragm arrangement, or a pivoted or otherwise movble flap or vane movable within the air inlet passage in accordance with the mass flow of air passing therethrough.

Although the disposition of main and auxiliary transfer passages and ports hereinbefore described is particularly advantageous in spark ignition engines, in which stratification of charge can be achieved, the disposition of ports is also effective in engines of other types, for example engines intended to work on a compression ignition cycle and having fuel injection means arranged to inject fuel directly into a compressed charge or air alone in the working part of the cylinder. Further, as an additional variation on the embodiment of engine described, a relatively weak mixture could be induced into the working parts of the cylinders through the main transfer passages, such mixture being too weak for reliable ignition and yet capable of burning once ignited, while additional fuel is supplied through the auxiliary transfer passages to lead to establishment of a combustible air-fuel mixture in the region of the ignition means.

I claim:

1. A two-stroke engine comprising a set of two cylinders each cylinder having a working part of smaller diameter and a pumping part of larger diameter; a piston slidably reciprocable in each cylinder and having a working part which slides in the working part of the cylinder and a pumping part which slides in the pumping part of the cylinder; and transfer passage means between the pumping part of each cylinder of the set and the working part of the other cylinder of the set so that at least the air for each charge required by the working part of each cylinder of the set is pumped, during operation of the engine, to such working part along transfer passage means from the pumping part of the other cylinder of the set, the piston motion within the cylinders of the set being such that the pistons are 180° out of phase, the improvement wherein:

I. the working part of each cylinder is provided with exhaust port means, main inlet ports and auxiliary inlet port means, II. the main inlet ports are arranged symmetrically about, and spaced from, a plane which contains the longitudinal axis of the cylinder and which passes through the center of the exhaust port means, III. the auxiliary inlet port means comprises at least one port in the cylinder wall opposite to the exhaust port means, IV. the transfer passage means comprises main transfer passage means connected to the main inlet port means and auxiliary transfer passage means connected to the auxiliary inlet port means, and V. the exhaust port means of both cylinders of the set lies to one side of an axial plane containing the axes of the two cylinders of the set and the auxiliary inlet port means of both cylinders of the set and auxiliary transfer passage means of the set lies wholly on the other side of said axial plane; and VI. means for supplying fuel to air which, when the engine is in use, passes through the auxiliary transfer passage means and the auxiliary inlet port means;

VII. means for sensing variations in the mass flow of air into the pumping parts of the cylinders of the set; and VIII. means for metering the fuel supply in dependence on variations in said mass flow.

2. An engine according to claim 1 wherein:

i. the main inlet ports of each cylinder are directed towards a zone of the cylinder diametrically opposite the exhaust port means and between the cylinder axis and the auxiliary inlet port means, ii. each auxiliary inlet port means is inclined to the axis of the cylinder and directed towards the cylinder head.

3. An engine according to claim 1 wherein the auxiliary inlet port means of each cylinder has a cross-sectional area less than half that of the main inlet ports of each cylinder, and the auxiliary inlet port means of each cylinder is arranged to open after the main inlet ports of that cylinder.

4. An engine according to claim 1 including a low-pressure fuel injector to spray fuel into each axiliary transfer passage means which has a well formation to prevent liquid fuel sprayed into the passage means by the injector from running down into the pumping parts of the cylinders.

5. An engine according to claim 1 wherein:

i. each main transfer passage means comprises a. a first portion extending from the pumping part of one of the cylinders generally parallel to said axial plane b. a second U-shaped portion leading to the main inlet ports of the working part of the other cylinder, ii. at least said first portions lie on the same side of the axial plane as the exhaust port means.

6. An engine according to claim 5 wherein the limbs of the generally U-shaped second portion of each main transfer passage means are of substantially equal lengths.

* * * * *